United States Patent [19]

Blanchard

[11] Patent Number: 4,881,836

[45] Date of Patent: Nov. 21, 1989

[54] INFORMATION DISPLAY MEANS FOR GARMENT HANGER HOOKS

[75] Inventor: Russell O. Blanchard, Zeeland, Mich.

[73] Assignee: Batts, Inc., Zeeland, Mich.

[21] Appl. No.: 179,023

[22] Filed: Apr. 7, 1988

[51] Int. Cl.[4] ..... G09F 3/00

[52] U.S. Cl. ..... 40/322; 223/85

[58] Field of Search ..... 40/322, 316; 223/85

[56] References Cited

U.S. PATENT DOCUMENTS

| | | | |
|---|---|---|---|
| 4,045,899 | 9/1977 | Richardson | 40/322 |
| 4,322,902 | 4/1982 | Lenthall | 40/322 |
| 4,679,340 | 7/1987 | Johansson | 40/322 |

FOREIGN PATENT DOCUMENTS

| | | | |
|---|---|---|---|
| 8304122 | 11/1983 | PCT Int'l Appl. | 40/322 |

*Primary Examiner*—Gene Mancene .
*Assistant Examiner*—Michael Lynch
*Attorney, Agent, or Firm*—Price, Heneveld, Cooper, DeWitt & Litton

[57] ABSTRACT

An information display means for garment hangers has a tubular body with a web of resilient material extending across the opening through the body. The web has an opening therethrough through which the hanger hook can be passed which opening is of a size and shape which will grip the hook with sufficient force to effectively hold the body against inadvertent rotation about the hook and thus keep the information visible. A single construction is capable of use on hangers having a wire hook and molded plastic hooks of a variety of cross-sectional shapes.

17 Claims, 2 Drawing Sheets

INFORMATION DISPLAY MEANS FOR GARMENT HANGER HOOKS

FIELD OF THE INVENTION

This invention relates to means for displaying information such as garment size on a hanger which means can be secured by mounting over the hook of the hanger.

BACKGROUND OF THE INVENTION

It is important to both retailers and customers to provide the customer certain information concerning clothing without the necessity for handling the garment. Not only does this save time, it also eliminates possible damage to or soiling of the garments due to handling. It also saves both customer and personnel time.

Many devices and systems have been developed for this purpose. However, each has had limitations which have restricted its use to one or two particular garment hanger constructions. Thus, each retailer has had to obtain identification means particularly adapted to its garment display system. This has resulted in many retailers still depending upon the practice of hanging tags for this purpose. To read the tags normally requires handling of the garment and this can result in soiling of the garment. It is also a relatively slow procedure.

Among the limitations which have complicated the identification system is the variety of hanger designs. Another complicating factor is whether the garment is to be displayed on a rack in which case it is seen only from one end of the hanger or so displayed so that it is viewed from the front. In an effort to overcome this, some systems provide a display means canted at an angle to the length of the hanger thereby providing a compromise between front and end displays. This solution is disclosed in U.S. Pat. No. 4,450,639 entitled HANGER WITH SIZE INDICATOR PANEL, issued May 29, 1984 to E. L. Duester. Others have mounted it over the hook to seat on top of the hanger body and have even provided a means for stabilizing the display device's rotational position around the hook. Still others have provided a split ring which can be resiliently snapped onto the hanger hook. These solutions are disclosed in U.S. Pat. No. 4,198,773 entitled TALLY FOR ARTICLE DISPLAYS, issued Apr. 22, 1980 to J. H. Batts et al. All of these various type of snap-on or push on information display devices are limited to use with plastic hangers having specific structural features. Thus, in a large clothing retail operation, a wide variety of identification means must be stocked and coordinated, all of which adds to the cost of merchandising the clothing.

BRIEF DESCRIPTION OF THE INVENTION

An information display attachment is provided which has a rectangular, tubular body with a web extending across its central opening. The web has an opening generally simulating a dumbbell with a pair of enlarged ends connected by a slot which is somewhat enlarged at its center. The tubular body, while suitable for mounting over a conventional wire hook, has an elongated cross-sectional shape which permits it also to be passed over the end of a molded plastic hook. It is also capable of resiliently clamping to the boss at the base of the hook for stability when used with a conventional wire hook. It is, therefore, substantially universal in application.

DESCRIPTION OF THE PREFERRED EMBODIMENT

Figure 1:
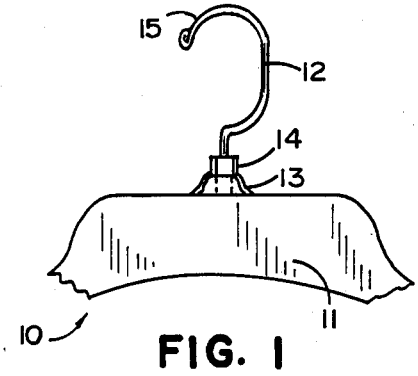
FIG. 1 is a front elevation view of a hanger having a wire hook and a size indicator mounting boss at the base of the hook.
Figure 10:
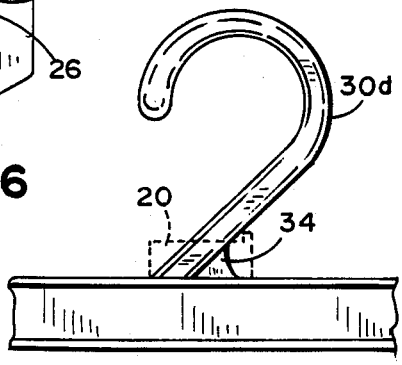
FIG. 10 is a fragmentary front elevation view similar to FIG. 2 illustrating the invention mounted on a hanger having a molded plastic hook with the invention shown in phantom to permit visual representation of the relationship of the hook base to the invention.
Figure 9:
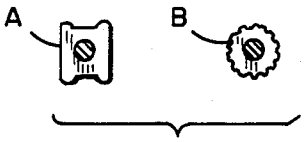
FIG. 9 illustrates two of the various types of bosses with which this invention can be used.
Figure 7:
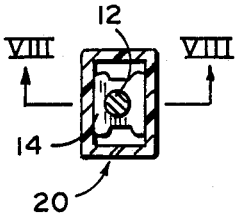
FIG. 7 is an enlarged sectional view taken along the plane VII—VII of FIG. 2.

Referring to FIG. 1, the numeral 10 identifies a hanger having a molded plastic body 11 supported by a wire hook 12. The hanger body, at its center, has a hook support and mount 13 at the top of which is a boss 14. The boss 14, as viewed from the top, can have a number of configurations, two of which are illustrated in FIG. 9. The boss 14 identified by the letter "A" is the one shown in FIGS. 1 and 7. The boss identified by the letter "B" is another frequently used shape. In any case, the boss is molded integral with the mount 13 and the hanger body 11. It has been conventional practice to mount a circular collar over the boss to display the desired information such as garment size. This type of display device is described in the previously identified U.S. Pat. No. 4,198,773. This type of display member is molded from a somewhat resilient plastic such as polypropylene and can be squeezed into an oval shape to pass over the doubled-back end 15 of the hook and when released resiliently engages the boss 14, irrespective of the shape of the boss. However, this type of circular display element can never be used with a hanger having a molded plastic hook, such as illustrated in FIG. 10, because to provide the hook with the necessary strength it has to be so shaped that it cannot accommodate a ring shaped element unless its diameter is much too large to clamp to one of the bosses 14.

Figure 6:
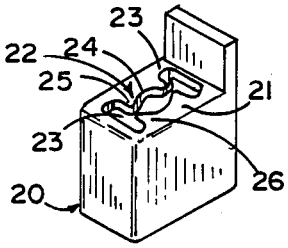
FIG. 6 is an enlarged, oblique view of a size indicator incorporating this invention.

To overcome this problem and provide a size indicia display element capable of use on both types of hangers, the display element 20 is provided with a tubular body of rectangular cross section having sides longer than the ends (FIG. 6). The length of the tubular body is at least equal to the height of the boss 14 and preferably is greater to provide sufficient room to display indicia of a size which will be clearly readable by the average customer.

One end of the tubular body is open while the other or upper end has a web 21. The web 21 has an elongated opening 22 with a somewhat enlarged center portion 24 communicating with a pair of laterally extending end slots 23. The openings at the juncture of the end portions and the center portions form throats 25 defined by inwardly directed tabs 26 which form openings narrower than the web of the plastic hooks to be passed through them. Thus, at least some or all of the tabs must be deflected to accommodate the hook (FIGS. 12–16). The web 21 and the body are molded as a single integral element of a material which is resilient and has memory such as polypropylene.

Figure 2:
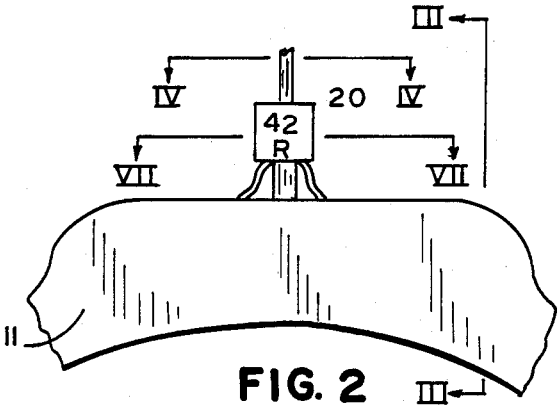
FIG. 2 is a fragmentary, enlarged front elevation view of the center portion of the hanger of FIG. 1 with the information display device of this invention mounted on the hanger.
Figure 4A:
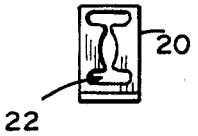
FIG. 4A is a view similar to FIG. 4 illustrating the size indicator before mounting on the hanger.
Figure 4:
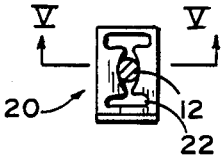
FIG. 4 is an enlarged top plan view of the size indicator taken along the plane IV—IV of FIG. 2.
Figure 8:
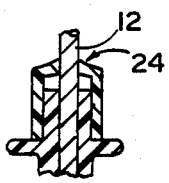
FIG. 8 is a fragmentary, sectional view of the mounted size indicator taken along the plane VIII—VIII of FIG. 7.
Figure 5:
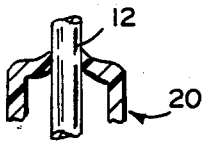
FIG. 5 is a fragmentary, enlarged view of the top of the indicator's engagement with a wire hook.

When the display element 20 is mounted on a hanger having a conventional wire hook, the doubled-back end 15 can be forced through the opening 22 by spreading the tabs 26 to enlarge the throats 25. The element 20 is then seated on the boss 14 with an end displayed toward the end of the hanger or toward the front of the hanger as shown in FIG. 2. The size of the center portion 24 of the opening is such that the web will seat firmly against and grip the wire of the hook 12 (FIG. 5). This is important in stabilizing the position of the element. If the end is displayed toward the front, a side will be displayed toward the end of the hanger and, thus, the hanger can be used either way, particularly if the information is displayed on both an end and a side. To stabilize the element against rotational displacement, the width of the element is such as to press against the boss 14 whether it is of the type A or B as illustrated in FIG. 9 because the sides of the elements are slightly spread to permit the element to be seated down over the boss. This forces the element to frictionally clamp to the boss to resist displacement. It will be noted from FIG. 8 that when used with a hanger having a wire hook, the sides of the center enlargement 24, by seating against the shank of the hook, help to stabilize the position of the element.

Figure 15:
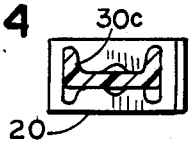
FIG. 15 is a fragmentary, oblique view of the base of the hook illustrated in FIG. 10.

Because of the construction of the display element 20, it can be used on hangers having a molded plastic hook (FIG. 10). It is for this purpose that the opening 22 has the two end slots 23 and an enlarged center portion 24. So designed, the opening 22 is capable of functioning with a variety of hook cross sections such as the hook 30 with an X-type cross section (FIG. 12) or a hook **30*a* with an I-beam type cross section (FIG. 13) or a hook 30*b* with a T-shaped cross section (FIG. 14) or a hook 30*c* with a C-shaped cross section (FIG. 15). In all cases, the tabs 26 defining the narrow throat 25 firmly engage all three hook shapes and, along with the ends of the opening, stabilize the position of the element about the hook. Because the element is molded from a resilient plastic, it can be used on hangers having hooks of a cross section which substantially fold back the tabs 26 on one side of the hook as is the case of the C-section hook (FIG. 15**).

Figure 11:
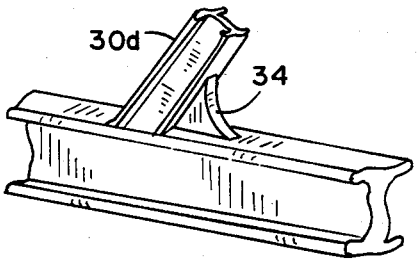
FIG. 11 is fragmentary view of the hanger shown in FIG. 10.
Figure 12:
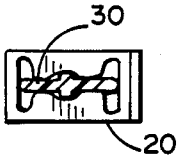
FIG. 12 is a cross section of a different hook construction with which this invention can be used.
Figure 14:
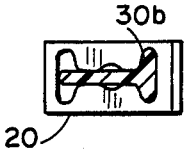
FIG. 14 is a cross section of still another hook construction with which this invention can be used.
Figure 13:
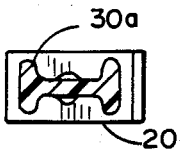
FIG. 13 is a cross section of another book construction with which this invention can be used.
Figure 16:
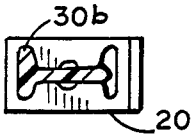
FIG. 16 is a sectional view taken along the plane XVI—XVI of FIG. 10 showing the size indicator in solid lines.

The invention can be used with hangers 32 having a molded hook 33 of I-beam cross section and a reinforcement flange 34 at the base (FIGS. 10, 11 and 16). In this case, the body of the hook is received toward one end with the flange 34 beneath the slot at the other end of the display element.

Figure 18:
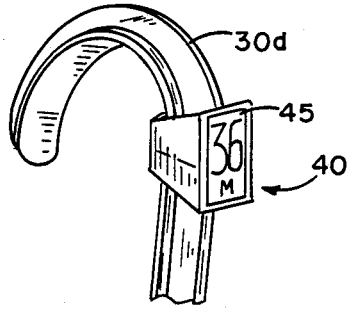
FIG. 18 is a fragmentary oblique view of the size indicator element of FIG. 15 mounted on a hook.
Figure 17:
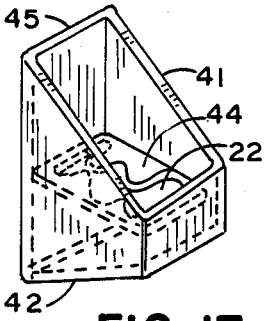
FIG. 17 is an enlarged, oblique view of a further modified construction for the size indicator element.

The same basic mounting concept can be used to provide a size indicator 40 which is secured part way between the top and bottom of a molded plastic hook 30d. In this construction, the top and bottom faces 41 and 42 of the display element 43 are inclined toward each other to form a tubular body which, from the side, is somewhat trapezoidal in shape and open at both ends (FIG. 17). Intermediate the open ends, an internal web 44 is provided of the same design and thickness as the web 21. The web 44 has the same resilient characteristics as the web 21 and serves the same function of gripping the hook. This size indicator is mounted on the hook by sliding it over the end of the hook and passing it down the hook to a position approximately midway between the top and bottom of the hook (FIG. 18). The necessary indicia will be displayed on the larger panel 45 of the element. The element 43 is preferably molded of the same plastic as the element 20 previously described.

Figure 19:
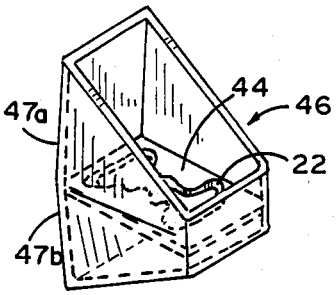
FIG. 19 is a side elevation view of a modified construction for the size indicator illustrated in FIG. 17.
Figure 3:
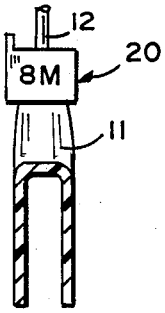
FIG. 3 is a sectional elevation view taken along the plane III—III of FIG. 2.

FIG. 19 illustrates a slightly modified construction for the size indicator of the type intended for telescopic mounting on the molded hook. In the display element 46 of this construction the display face has two sections **47*a* and *b*** arranged at a minor angle to each other. This is more of an ornamental than a functional difference.

It is important to this invention that the shape of the hook aperture through the web which bridges the opening through the information display device is shaped that not only can it be mounted on a variety of hooks of different constructions, it is also capable of gripping each of the hook types with sufficient pressure to positively stabilize the device. This is important in assuring that the device will remain in place and thus properly display the necessary information.

In the case of all of the information display devices which have been described, the indicia can be molded as a raised configuration on the element and made visible by applying a contrasting color to the indicia surface. The information can simply be printed on the display divide in a contrasting color. An alternative method is to apply an adhesively backed, printed sticker to the face of the element in the manner long practiced in the retail clothing field. An example of a suitable label and means to apply it is described in U.S. Pat. No. 4,660,739, entitled LABEL DISPENSER, issued Apr. 28, 1987 to E. L. Duester et al. In the case of display element 20, the indicia can be applied to the end and to one or both of the side panels.

Having described the preferred embodiment of my invention and several modifications thereof, it will be recognized that additional modifications can be made without departing from the principle of the invention.

Such modifications are to be considered as included in the hereinafter appended claims, unless the language thereof clearly states otherwise.

I claim:

1. An information display means adapted to be mounted on and surround the base of a support hook of a garment hanger which base portion of said support hook has non-circular cross-sectional shape, said display means being a tubular body having a pair of ends, said tubular body being of rectangular cross section and providing a display panel adapted to face lengthwise of the hanger, said body having a web extending across the opening through said body, said web having an aperture, said aperture having an elongated primary portion having a pair of ends and a pair of slot-like end portions communicating with said ends of said primary portion and extending transversely of said primary portion, said primary portion midway between its ends having an enlarged somewhat circular central portion separated from each of said end portions by a narrow throat substantially closing said primary portion, said body and said web being molded of a plastic capable of resilient deflection whereby said web clamps against the base of the hook of the garment hanger and positively holds the display means against rotation about the hook.

2. The information display means described in claim 1 wherein the size of said aperture is such that the cross-sectional body of the hook over which it is mounted will cause at least a portion of the web to be deflected and press against the hook.

3. The information display means described in claim 1 wherein said web is located at one end of said ends of the body.

4. The information display means described in claim 1 wherein said web is located intermediate said ends of the body.

5. The information display means described in claim 4 wherein said hook has a curved portion intermediate its top and bottom and said ends of said body are inclined toward each other whereby said body has a generally trapezoidal shape providing a pair of generally parallel faces of substantially different sizes the larger one of which serves as the display panel and is for mounting on the outer face of said curved portion of the hook with the display panel facing lengthwise of the hanger.

6. The information display means described in claim 1 wherein said body is rectangular in cross section having side panels and end panels, said end panels being narrower than the side panels and providing indicia displaying exterior faces.

7. The information display means described in claim 6 wherein the hanger has an elongated body and said end panels are directed toward the ends of the body, one of said end panels being vertically longer than the other.

8. The information display means described in claim 1 wherein said throats are each formed by a pair of resiliently deflectable tabs which extend toward each other to substantially close said throats.

9. In combination, a molded plastic garment hanger having an integral molded plastic hook, a size indicator having a tubular body of rectangular cross section all four faces of which form panels suitable for display of information, said hook in cross section having a first flange extending lengthwise of the body and a second flange integral with and normal to said first flange, said body having a web extending across the opening through said body, said web closing said opening except for an elongated slot-like primary aperture and a secondary slot-like aperture extending transversely thereof at each end of and communicating with said primary aperture, said primary aperture having an enlarged somewhat circular central portion separated from each of said secondary apertures by a narrow throat substantially closing said primary aperture, said body and said web being molded of a plastic capable of resilient deflection, said size indicator surrounding said hook at its case with the hook extending through said web with its first flange passing through said primary aperture and said second flange passing through one of said secondary apertures, and the sides of said primary aperture resiliently pressing against the sides of said hook and holding said body from rotating about the axis thereof.

10. The combination described in claim 9 wherein the hook in cross section has the shape of a cross.

11. The combination described in claim 9 wherein the hook in cross section is T-shaped.

12. The combination described in claim 9 wherein the hook in cross section is I-beam shaped.

13. The combination described in claim 9 wherein the hook in cross section is C-shaped.

14. An information display element adapted to be mounted on and surround the support hook of a garment hanger having a body the hook of which is molded integrally therewith and having a first flange extending lengthwise of the body and a second flange perpendicular thereto, said display element being tubular with a central opening therethrough and of rectangular shape having two side panels and two end panels for entirely surrounding a portion of said hook, at least one of which panels forms an indicia display panel, said display element having a web extending across and closing said central opening through the display element except for a hook passage extending therethrough, said hook passage having an elongated primary opening and a pair of secondary openings, one communicating with each end of said primary opening and extending transversely of said primary opening, one of said secondary openings being adapted to receive said second flange therein when said first flange is seated in said primary opening; the width of at least portions of said primary opening being such that the sides of said primary opening are deflected and press resiliently against said hook to stabilize it with the second flange holding said display element against rotation about said hook.

15. An information display element as described in claim 14 wherein said hook has a third flange like said second flange at the and of said first flange opposite from and parallel to said second flange, said third flange being seated in the other of said secondary openings through said web and with said first and second flanges preventing rotation of said element about said hook.

16. In combination, a hanger having a molded plastic body and a wire hook, an upstanding boss of generally rectangular cross section integral with said hanger body surrounding the base of said hook, a size indicator having a tubular body of rectangular cross section all sides of which are capable of displaying indicia, said tubular body being of a size such that at least two parallel sides of said tubular body will seat firmly against said boss, said tubular body having a web extending across the opening through said tubular body, said web having an elongated slot-like aperture with slot-like transverse end portions and an enlarged somewhat circular central portion joined to each of said end portions by a narrow throat, said tubular body and said web being molded of a plastic capable of resilient deflection, said size indicator being seated over said boss with its sides clamping against and entirely surrounding the boss with said indicator being held against rotation about said boss and hook; the web at the center opening of the aperture resiliently clamping the hook.

17. The combination recited in claim 16 wherein said web is spaced from both ends of said body.

* * * * *